US005261583A

United States Patent [19]

Long et al.

[11] Patent Number: 5,261,583

[45] Date of Patent: Nov. 16, 1993

[54] USER ADJUSTABLE RETENTION LATCH FOR PAGER HOLSTER

[75] Inventors: Christopher R. Long, Boca Raton; Melvin Teitzman, Lantana; Michael S. Bent, Greenacres, all of Fla.

[73] Assignee: Motorola, Inc., Schaumburg, Ill.

[21] Appl. No.: 880,276

[22] Filed: May 8, 1992

[51] Int. Cl.[5] ..... B65D 25/04

[52] U.S. Cl. ..... 224/245; 224/252; 224/269; 206/305; 206/493; 24/3 F; 24/3 L

[58] Field of Search ..... 224/191, 194, 230, 235, 224/242, 245, 246, 247, 252, 269, 904, 253, 271, 272; 206/38, 305, 493; 455/347, 351; 248/689; 24/3 F, 3 H, 3 L, 3 M, 3 R, 3 J, 11 HC, 336

[56] References Cited

U.S. PATENT DOCUMENTS

| | | | |
|---|---|---|---|
| 3,808,642 | 5/1974 | Nation | 24/3 F |
| 4,485,946 | 12/1984 | Liautaud et al. | 224/242 |
| 4,667,374 | 5/1987 | Bianchi | 224/252 X |
| 4,956,895 | 9/1990 | Hayasaka | 24/3 J |
| 5,100,037 | 3/1992 | Kopyta et al. | 224/245 |

*Primary Examiner*—Henry J. Recla
*Assistant Examiner*—Glen T. Barrett
*Attorney, Agent, or Firm*—Daniel R. Collopy; Kelly A. Gardner; Thomas G. Berry

[57] ABSTRACT

A holster (100) for receiving a pager (220) having an protrusion (225) comprises a housing (105) having an interior surface (205) and an exterior surface (210), the interior surface (205) forming a cavity (215) for receiving the pager (220). A flexible arm (110) is affixed to the housing (105) and moves between a first position wherein the flexible arm (110) engages the pager protrusion (225) when the pager (220) is within the cavity (215) and a second position wherein the flexible arm (110) is deflected by the pager protrusion (225) as the pager (220) is inserted into or removed from the cavity (215). A belt clip (230) mounted to the housing (105) secures the holster (100) to an article. The belt clip (230) selectably contacts the flexible arm (110) and exerts a pressure thereto which increases the force needed to deflect the flexible arm (110) when the pager (220) is inserted into or removed from the cavity (215).

12 Claims, 2 Drawing Sheets

USER ADJUSTABLE RETENTION LATCH FOR PAGER HOLSTER

FIELD OF THE INVENTION

This invention relates in general to portable pagers, and more specifically to holsters for carrying pagers.

BACKGROUND OF THE INVENTION

Conventional pagers receive selective call messages, i.e., pages, transmitted by a selective call terminal. A pager alerts a user when a selective call message addressed to the pager has been received, and, if the pager utilizes an output device such as a liquid crystal display (LCD), the user may read the message. Because the user may desire to carry a pager during certain times of the day, the pager may incorporate a belt clip, whereby the user may secure the pager to an article of clothing such as a belt or a pocket. If the pager, however, utilizes an LCD to present the message to the user, the user may be unable to read the message, due to the typically small size of the LCD, while the pager is secured to his belt. Under such a circumstance, the user might need to remove the pager from his belt to bring the pager LCD into his line of vision in order to read each message received by the pager. To circumvent this problem, conventional pagers may be placed within holsters which incorporate a belt clip which is typically fastened to a belt or other article of clothing. Preferably, the user avoids having to unfasten the belt clip from his belt every time he desires to read a message by simply sliding the pager from the holster.

Conventional holsters secure the pager within the holster in a number of ways. Some conventional holsters incorporate a user adjustable restraining strap that is fastened around the pager by means such as a buckle or snap to secure the pager within the holster. Other conventional holsters are designed to rigidly surround the pager tightly enough to secure the pager, yet are flexible enough so that the pager may be forced into and out of the holster by the user. Still other holsters have a retaining element that surrounds the pager and is deflected by the force of the user inserting or removing the pager from the holster. When the pager is inside the holster, the retaining element shifts back into a position surrounding the pager that prevents the pager from being removed from the holster without the application of sufficient force by the user.

Although holsters incorporating restraining straps do not require the use of force to insert or remove the pager, the user must manipulate the fastening of the strap to access or secure the pager. In this case, the user must not only insert the pager into the holster, but also perform the additional operation of securing the pager in the holster by tightening and fastening the restraining strap. In order to read a received message, it may become tedious and time consuming for a user to remove a pager having a restraining strap from the holster.

As to non-strap holsters, the force needed to insert or remove a pager from a conventional rigid holster is dependent upon the design of the holster. Each holster thereafter manufactured according to the design of a specific holster will have substantially the same material properties and will need substantially the same amount of force to insert or remove the pager from the holster. The user has no control of the tension holding the pager within the holster and no means for adjusting the tension. This could inconvenience a user who receives an inordinate number of messages and may wish to remove the pager from the holster more easily than dictated by the design specifications of the holster. Conversely, a user could lose a pager which requires too little force to secure the pager within the holster.

Thus, what is needed is a holster having user adjustable retaining characteristics.

SUMMARY OF THE INVENTION

According to a first aspect of the present invention, a holster for receiving a pager having a protrusion comprises a housing having an interior surface and an exterior surface, wherein the interior surface forms a cavity for receiving the pager. The holster further comprises a flexible arm affixed to the housing, wherein the flexible arm moves between a first position, in which the flexible arm engages the protrusion when the pager is within the cavity, and a second position, in which the flexible arm is deflected by the protrusion as the pager is inserted into or removed from the cavity. The holster still further comprises a belt clip mounted to the housing for securing the holster to an article. The belt clip selectably contacts the flexible arm and exerts a pressure thereto which increases the force needed to deflect the flexible arm when the pager is inserted into and removed from the cavity.

DESCRIPTION OF A PREFERRED EMBODIMENT

Figure 1:
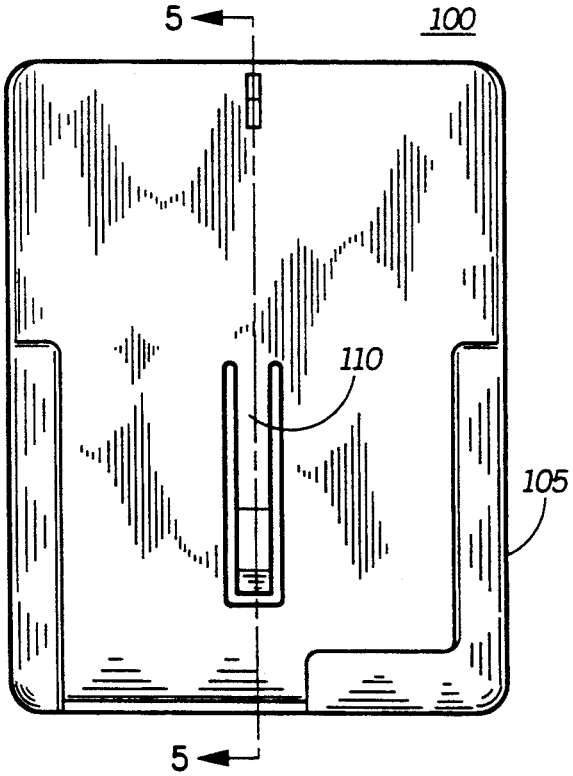
FIG. 1 is a front planar view of a holster having a retention latch in accordance with a preferred embodiment of the present invention.

Referring to FIG. 1, a holster 100 for carrying a portable pager comprises a housing 105. A flexible cantilever arm 110 is formed into the holster housing 105 for retaining the pager within the holster 100.

Figure 2:
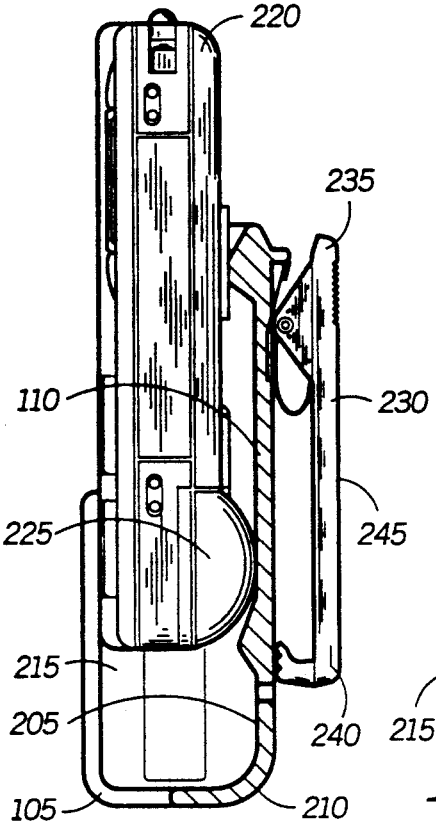
FIGS. 2, 3, and 4 are cutaway views depicting insertion and retention of a pager within the holster of FIG. 1 in accordance with the preferred embodiment of the present invention.

Referring next to FIG. 2, a cutaway view of the the holster 100 (FIG. 1) is depicted. The holster housing 105 has an interior surface 205 and an exterior surface 210. The interior surface 205 forms a cavity 215 wherein a pager 220 having a protrusion 225 may be retained by the flexible arm 110. The flexible arm 110 is shown in a first position, wherein the flexible arm 110 is flush with the exterior surface 210 of the holster housing 105.

In accordance with a preferred embodiment of the present invention, a belt clip 230 is mounted to the holster 100 (FIG. 1). The belt clip 230 allows the user to conveniently secure the holster 100 to an article such as a belt or a shirt pocket, thereby preventing the loss of the pager 220. A first end 235 of the belt clip 230 is pivotally mounted to the exterior surface 210 of the housing 105, and a rigid member 245 connects the first end 235 of the belt clip 230 to a second end 240 of the belt clip 230. The belt clip 230 may be pivotally rotated between a closed position, depicted in FIG. 2, wherein the second end 240 of the belt clip 230 contacts the flexible arm 110 and exerts a pressure against the flexible arm 110, and an open position. When the belt clip 230 is rotated by the user into the open position, a belt or other such article may be inserted between the belt clip 230 and the exterior surface 210 of the holster housing 105. After placement of the belt between the belt clip 230 and the exterior surface 210, the belt clip 230 is rotated into the closed position to secure the belt between the belt clip 230 and the exterior surface 210 of the holster housing 105. In this manner, the user may attach the holster 100 (FIG. 1) to his belt or pocket so that the holster 100 may be used to carry the pager 220 whenever the user desires.

Figure 3:
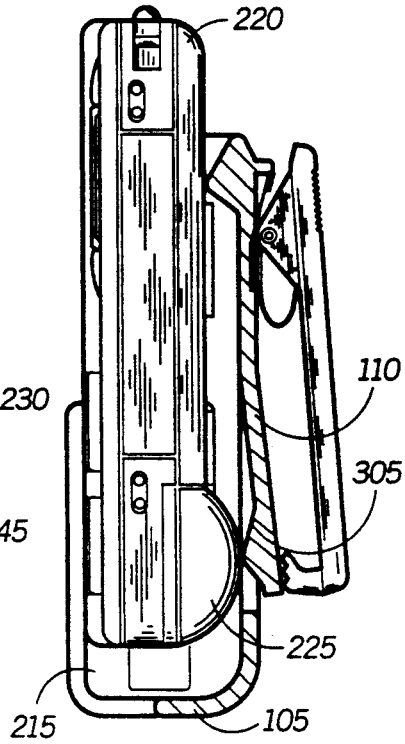

FIG. 3 illustrates insertion of the pager 220 into the cavity 215 formed by the interior surface 205 of the housing 105. As the pager 220 is inserted into the cavity 215, the pager protrusion 225 forcibly slides past a first angled surface 305 formed into the flexible arm 110, thereby deflecting the flexible arm 110 into a second position as shown.

Figure 4:
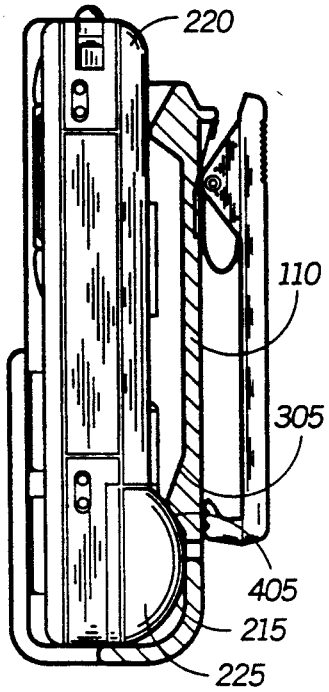

Once the pager extrusion 225 has been forcibly inserted past the first angled surface 305 of the flexible arm 110, as depicted in FIG. 4, the flexible arm 110 resumes the first position. The pager 220 is retained in the cavity 215 by a second angled surface 405 formed into the flexible arm 110 opposite the first angled surface 305. The second angled surface 405 engages the pager protrusion 225 and prevents the pager 220 from being removed from the cavity 215 without the application of force by the user. If the user desires to remove the pager 220 from the housing cavity 215, he must apply sufficient force to slide the pager protrusion 225 past the second angled surface 405, thereby deflecting the flexible arm 110 into the second position shown in FIG. 2. The use of the flexible arm 110 to retain the pager 220 within the holster 100 (FIG. 1) allows the user to quickly insert and remove the pager 220 from the holster 100. The user does not need to perform the time consuming operations of fastening or unfastening a restraining strap as in some conventional holsters.

In accordance with the present invention, the second angled surface 405 is formed at a steeper angle than the first angled surface 305. The steeper angle of the second angled surface 405 dictates that the force required to remove the pager 220 from the cavity 215 is greater than the force required to insert the pager 220 into the cavity 215. This allows the user to insert the pager 220 into the holster 100 (FIG. 1) more easily than he can remove the pager 220 from the holster 100. Preferably, the second angled surface 405 is formed at a steep enough angle to prevent the accidental dislodging of the pager 220 from the holster 100. This feature may advantageously prevent the loss of the pager 220 from the holster 100.

Figure 5:
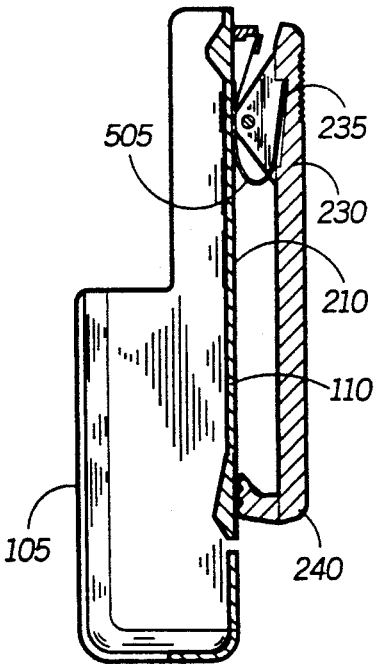
FIG. 5 is a cutaway view along line 5—5 of FIG. 1 of the user adjustable retention latch in accordance with the preferred embodiment of the present invention.

A further feature in accordance with the preferred embodiment of the present invention is illustrated in FIG. 5, wherein a spring element 505 is coupled between the first end 235 of the belt clip 230 and the exterior surface 210 of the holster housing 105. The spring element 505 provides a tension between the belt clip 230 and the exterior surface 210 such that the user must force the belt clip 230 into the open position. When the belt clip 230 is in the closed position, the tension provided by the spring element 505 forces the second end 240 of the belt clip 230 to contact the flexible arm 110, wherein the second end 240 exerts a pressure on the flexible arm 110. The pressure exerted by the second end 240 of the belt clip 230 on the flexible arm 110 is such that additional force is required to insert and remove the pager 220 (FIG. 4) from the holster 100 (FIG. 1). In accordance with the present invention, the tension of the spring element 505 is user adjustable. By increasing or decreasing the tension provided by the spring element 505, the pressure exerted by the second end 240 of the belt clip 230 on the flexible arm 110 may be increased or decreased. This feature advantageously allows the user to adjust the tension of the spring element 505 to determine the amount of force needed to insert and withdraw the pager 220 (FIG. 4) from the holster 100 (FIG. 1).

Figure 6:
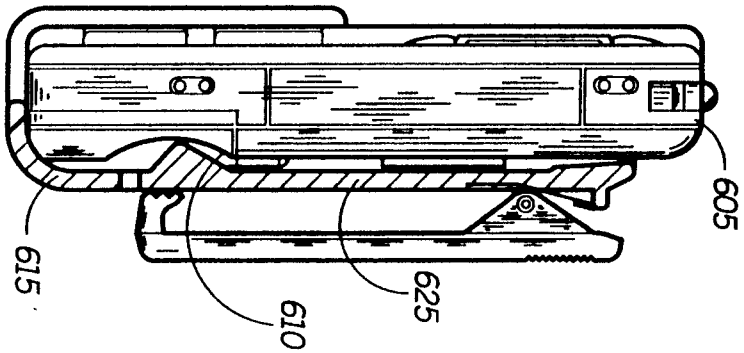
FIG. 6 is a cutaway view depicting retention of a pager within a holster in accordance with an alternate embodiment of the present invention.

FIG. 6 depicts a cutaway view of an alternate embodiment of the present invention wherein a pager 605 having a recess 610 is secured within a holster 615. Once situated within the holster 615, a flexible arm 625 engages the pager recess 610 to restrain the pager 605 within the holster 615. The operations of insertion and removal of the pager 605 from the holster 615 are performed in a similar manner as those described in the preferred embodiment of the present invention.

The holster in accordance with the preferred embodiment of the present invention provides several advantages over conventional holsters. Because the holster does not require that the user perform the time consuming steps of fastening and unfastening a restraining device, such as a restraining strap employed by some conventional holsters, the pager may be more quickly placed into and securely restrained within the holster. This feature further allows the user to easily remove the pager from the holster to read a received message without unfastening a restraining strap.

Additionally, the steeper angle of the second angled surface formed into the flexible arm require that a greater force must be used to withdraw the pager of FIGS. 1-5 from the holster than to insert the pager into the holster. The use of this feature in accordance with the present invention may help prevent the loss of the pager. If, for example, the user unknowingly brushes against the pager while it is restrained within the holster, the steeper angle of the second angled surface formed into the flexible arm may prevent the pager from being accidentally dislodged from the holster. In this manner, the pager may be restrained within the pager until the user applies sufficient force to intentionally remove the pager from the holster.

A still further feature incorporated by the holster is the user adjustable retention force by which the pager is secured within the holster. Because the restraining characteristics of conventional holsters are determined by the designer, rather than the user, each holster thereafter manufactured according to the design of a specific holster will have substantially the same material properties and will need substantially the same amount of force to insert or remove the pager from the holster. The user could be inconvenienced if he desires the pager to be secured within the holster more tightly or more loosely than designed. In accordance with the present invention, however, the user may advantageously vary the retention force that secures the pager within the holster. In this manner, each user may adjust the amount of force needed to insert or remove the pager from the holster. The user may decrease the force needed to remove the pager from the holster, for example, if he anticipates reception of an excessive number of pages within a particular period of time. If the user later desires to restrain the pager more securely within the holster, he may readjust the retention force by which the pager is restrained.

By now it should be appreciated that there has been provided a holster having user adjustable retaining characteristics.

What is claimed is:

1. A holster for receiving a pager having a protrusion, the holster comprising:

a housing having an interior surface and an exterior surface, the interior surface forming a cavity for receiving the pager;

a flexible arm affixed to the housing, the flexible arm moving between a first position wherein the flexible arm engages the pager protrusion when the pager is within the cavity and a second position wherein the flexible arm is deflected by the pager protrusion as the pager is inserted into or removed from the cavity; and a belt clip mounted to the housing for securing the holster to an article, the belt clip selectably contacting the flexible arm and exerting a pressure thereto which increases the force need to deflect the flexible arm when the pager is inserted into and removed from the cavity.

2. The holster in accordance with claim 1, wherein the flexible arm comprises a first angled surface being formed into the flexible arm such that the pager protrusion forcibly slides past the first angled surface, thereby deflecting the flexible arm, as the pager is inserted into the cavity.

3. The holster in accordance with claim 2, wherein the flexible arm further comprises a second angled surface being formed into the flexible arm opposite the first angled surface such that the pager protrusion forcibly slides past the second angled surface, thereby deflecting the flexible arm, as the pager is removed from the cavity.

4. The holster in accordance with claim 3, wherein the second angled surface is steeper than the first angled surface, thereby requiring a greater force to deflect the flexible arm when the pager is removed from the cavity than when the pager is inserted into the cavity.

5. The holster in accordance with claim 1, wherein the belt clip comprises:

a first end mounted to the exterior surface of the holster housing;

a second end for selectably contacting the flexible arm; and a rigid member securing the first end to the second end, wherein the belt clip may be maneuvered between an open position, such that an article may be inserted between the belt clip and the exterior surface of the holster housing, and a closed position such that the article may be secured between the exterior surface of the holster housing and the belt clip.

6. The holster in accordance with claim 5, further comprising mounting means for mounting the first end of the belt clip to the exterior surface of the holster housing, the mounting means comprising tension means for adjusting the pressure exerted by the second end against the flexible arm.

7. The holster in accordance with claim 6, wherein the tension means comprises a spring element having a tension and coupled to the first end and to the exterior surface of the holster housing for providing the tension between the belt clip and the exterior surface of the holster housing, wherein the pressure exerted by the second end on the flexible arm may be increased or decreased by adjusting the tension of the spring element.

8. A holster for receiving a pager having a protrusion, the holster comprising:

a housing having an interior surface and an exterior surface, the interior surface forming a cavity for receiving the pager, wherein a flexible arm is formed into the housing such that the flexible arm engages the pager protrusion when the pager is within the cavity, the flexible arm comprising:

a first angled surface being formed into the flexible arm such that the pager protrusion forcibly slides past the first angled surface, thereby deflecting the flexible arm, as the pager is inserted into the cavity; and a second angled surface being formed into the flexible arm opposite the first angled surface such that the pager protrusion forcibly slides past the second angled surface, thereby deflecting the flexible arm, as the pager is removed from the cavity, wherein the second angled surface is steeper than the first angled surface, thereby requiring a greater force to deflect the flexible arm when the pager is removed from the cavity than when the pager is inserted into the cavity;

a belt clip comprising:

a first end pivotally mounted to the exterior surface of the holster housing;

a second end for selectably contacting the flexible arm;

a rigid member securing the first end to the second end, wherein:

the first end pivotally rotates the belt clip between an open position, such that an article may be inserted between the belt clip and the exterior of the holster housing, and a closed position, such that the article may be secured between the exterior surface of the holster housing and the belt clip; and the second end, when the belt clip is in the closed position, contacts the flexible arm and exerts a pressure thereto which increases the force needed to deflect the flexible arm as the pager is inserted into and removed from the cavity; and a spring element is coupled between the first end and the exterior surface of the holster housing for providing tension between the belt clip and the exterior surface of the holster housing, wherein the pressure exerted by the second end on the flexible arm may be increased or decreased by adjusting the tension of the spring element.

9. A holster for receiving a pager having a recess, the holster comprising:

a housing having an interior surface and an exterior surface the interior surface forming a cavity for receiving the pager; and a flexible arm affixed to the housing, the flexible arm moving between a first position wherein the flexible arm engages the pager recess when the pager is within the cavity and a second position wherein the flexible arm is deflected as the pager is inserted into or removed from the cavity; and a belt clip mounted to the housing for securing the holster to an article, the belt clip selectably contacting the flexible arm and exerting a pressure thereto which increases the force needed to deflect the flexible arm when the pager is inserted into and removed from the cavity.

10. The holster in accordance with claim 9, wherein the belt clip comprises:

a first end coupled to the exterior surface of the holster housing;

a second end for selectably contacting the flexible arm; and a rigid member securing the first end to the second end, wherein the belt clip may be maneuvered between an open position, such that an article may be inserted between the belt clip and the exterior surface of the housing, and a closed position, such that the article may be secured between the exterior surface of the holster housing and the belt clip.

11. The holster in accordance with claim 10, further comprising mounting means for mounting the first end of the belt clip to the exterior surface of the holster housing, the mounting means comprising tension means for adjusting the pressure exerted by the second end against the flexible arm.

12. The holster in accordance with claim 11, wherein the tension means comprises a spring element having a tension coupled to the first end and to the exterior surface of the holster housing for providing the tension between the belt clip and the exterior surface of the holster housing, wherein the pressure exerted by the second end on the flexible arm may be increased or decreased by adjusting the tension of the spring element.

* * * * *